US007484597B2

(12) United States Patent
Nikovski et al.

(10) Patent No.: US 7,484,597 B2
(45) Date of Patent: Feb. 3, 2009

(54) SYSTEM AND METHOD FOR SCHEDULING ELEVATOR CARS USING BRANCH-AND-BOUND

(75) Inventors: Daniel N. Nikovski, Cambridge, MA (US); Matthew E. Brand, Newton, MA (US); Dietmar Ebner, Vienna (AT)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 522 days.

(21) Appl. No.: 11/389,942

(22) Filed: Mar. 27, 2006

(65) Prior Publication Data

US 2007/0221455 A1 Sep. 27, 2007

(51) Int. Cl.
*B66B 1/18* (2006.01)

(52) U.S. Cl. ..... 187/382; 187/247

(58) Field of Classification Search ..... 187/247, 187/248, 380–389, 391, 393
See application file for complete search history.

(56) References Cited

U.S. PATENT DOCUMENTS 6,000,504 A * 12/1999 Koh et al. ..... 187/382
6,293,368 B1 * 9/2001 Ylinen et al. ..... 187/382
6,644,442 B1 * 11/2003 Ylinen et al. ..... 187/382
6,776,264 B2 * 8/2004 Tyni et al. ..... 187/382
6,889,799 B2 * 5/2005 Tyni et al. ..... 187/282
6,913,117 B2 * 7/2005 Tyni et al. ..... 187/382
7,140,472 B2 * 11/2006 Tyni et al. ..... 187/382

OTHER PUBLICATIONS

Nikovski et al., "Decision-theoretic group elevator scheduling," 13th International Conference on Automated Planning and Scheduling, Jun. 2003.

* cited by examiner

*Primary Examiner*—Jonathan Salata
(74) *Attorney, Agent, or Firm*—Dirk Brinkman; Gene V. Vinokur

(57) ABSTRACT

A method schedules cars of an elevator system. Each possible assignment of a set of hall calls to a set of cars is represented by a solution vector maintained as a node in a search tree. Each solution vector is evaluated using an ESA-DP process according to an immediate policy to determine initially a best solution. A branch-and-bound process is applied to each solution vector using the initial best solution and the search tree to determine a globally optimal solution for scheduling the cars according to a reassignment policy.

9 Claims, 4 Drawing Sheets

100

SYSTEM AND METHOD FOR SCHEDULING ELEVATOR CARS USING BRANCH-AND-BOUND

RELATED APPLICATION

This application is related to U.S. patent application Ser. No. 11/390,508 entitled "System and Method for Scheduling Elevator Cars Using Pairwise Delay Minimization," which was co-filed with this application on Mar. 27, 2006 by Nikovski et al.

FIELD OF THE INVENTION

This invention relates generally to scheduling elevator cars, and more particularly to scheduling methods that operate according to a reassignment policy.

BACKGROUND OF THE INVENTION

Scheduling elevator cars is a practical optimization problem for banks of elevators in buildings. The object is to assign arriving passengers to cars so as to optimize one or more performance criteria such as waiting time, total transfer time, percentage of people waiting longer than a specific threshold, or fairness of service.

The scheduling of elevator cars is a hard combinatorial optimization problem due to the very large number of possible solutions (the solution space), uncertainty arising from unknown destination floors of newly arriving passengers, and from unknown arrival times of future passengers.

The most commonly accepted optimization criterion is the average waiting time (AWT) of arriving passengers, G. C. Barney, "Elevator Traffic Handbook," Spon Press, London, 2003; G. R. Strakosch, "Vertical transportation: elevators and escalators," John Wiley & Sons, Inc., New York, N.Y., 1998; and G. Bao, C. G. Cassandras, T. E. Djaferis, A. D. Gandhi, and D. P. Looze, "Elevator dispatchers for downpeak traffic," Technical report, University of Massachusetts, Department of Electrical and Determiner Engineering, Amherst, Mass., 1994.

Another important consideration is the social protocol under which the scheduler is operating. In some countries, e.g., Japan, each assignment is made at the time of the hall call of the arriving passenger, and the assignment is not changed until the passenger is served. This is called an immediate policy. In other countries, e.g., the U.S., the system can reassign hall calls to different cars if this improves the schedule. This is called a reassignment policy. While the reassignment policy increases the computational complexity of scheduling, the additional degrees of freedom can be exploited to achieve major improvements of the AWT.

In practice, it is assumed that passenger dissatisfaction grows supra-linearly as a function of the AWT. When minimizing objective functions, one penalizes long waits much stronger than short waits, which helps to reduce extensive long waits, see M. Brand and D. Nikovski, "Risk-averse group elevator scheduling," Technical report, Mitsubishi Electric Research Laboratories, Cambridge, Mass., 2004; and U.S. patent application Ser. No. 10/161,304, "Method and System for Dynamic Programming of Elevators for Optimal Group Elevator Control," filed by Brand et al. on Jun. 3, 2002, both incorporated herein by reference.

Another method determines the AWT of existing passengers and future passengers, Nikovski et al., "Decision-theoretic group elevator scheduling," 13$^{th}$ International Conference on Automated Planning and Scheduling, June 2003; and U.S. patent application Ser. No. 10/602,849, "Method and System for Scheduling Cars in Elevator Systems Considering Existing and Future Passengers," filed by Nikovski et al. on Jun. 24, 2003, both incorporated herein by reference. That method is referred to as the "Empty the System Algorithm by Dynamic Programming" (ESA-DP) method.

The EAS-DP method determines a substantially exact estimation of waiting times. The method takes into account the uncertainty arising from unknown destination floors of passengers not yet been served, or passengers that have not yet indicated their destination floor. That method represents the system by a discrete-state Markov chain and makes use of dynamic programming to determine the AWT averaged over all possible future states of the system. Despite of the large state space, the performance of the method is linear in the number of floors of the building and number of shafts, and quadratic in the number of arriving passengers.

The run time of ESA-DP method is completely within the possibilities of modern micro-controllers and the quality of its solutions lead to major improvements when compared with other scheduling methods. However, that method does not exploit the additional potential of elevator systems operating according to the reassignment policy.

SUMMARY OF THE INVENTION

A method schedules cars of an elevator system. Each possible assignment of a set of hall calls to a set of cars is represented by a solution vector maintained as a node in a search tree. Each solution vector is evaluated using an ESA-DP process according to an immediate policy to determine initially a best solution. A branch-and-bound process is applied to each solution vector using the initial best solution and the search tree to determine a globally optimal solution for scheduling the cars according to a reassignment policy.

DETAILED DESCRIPTION OF THE PREFERRED EMBODIMENT

Figure 1:
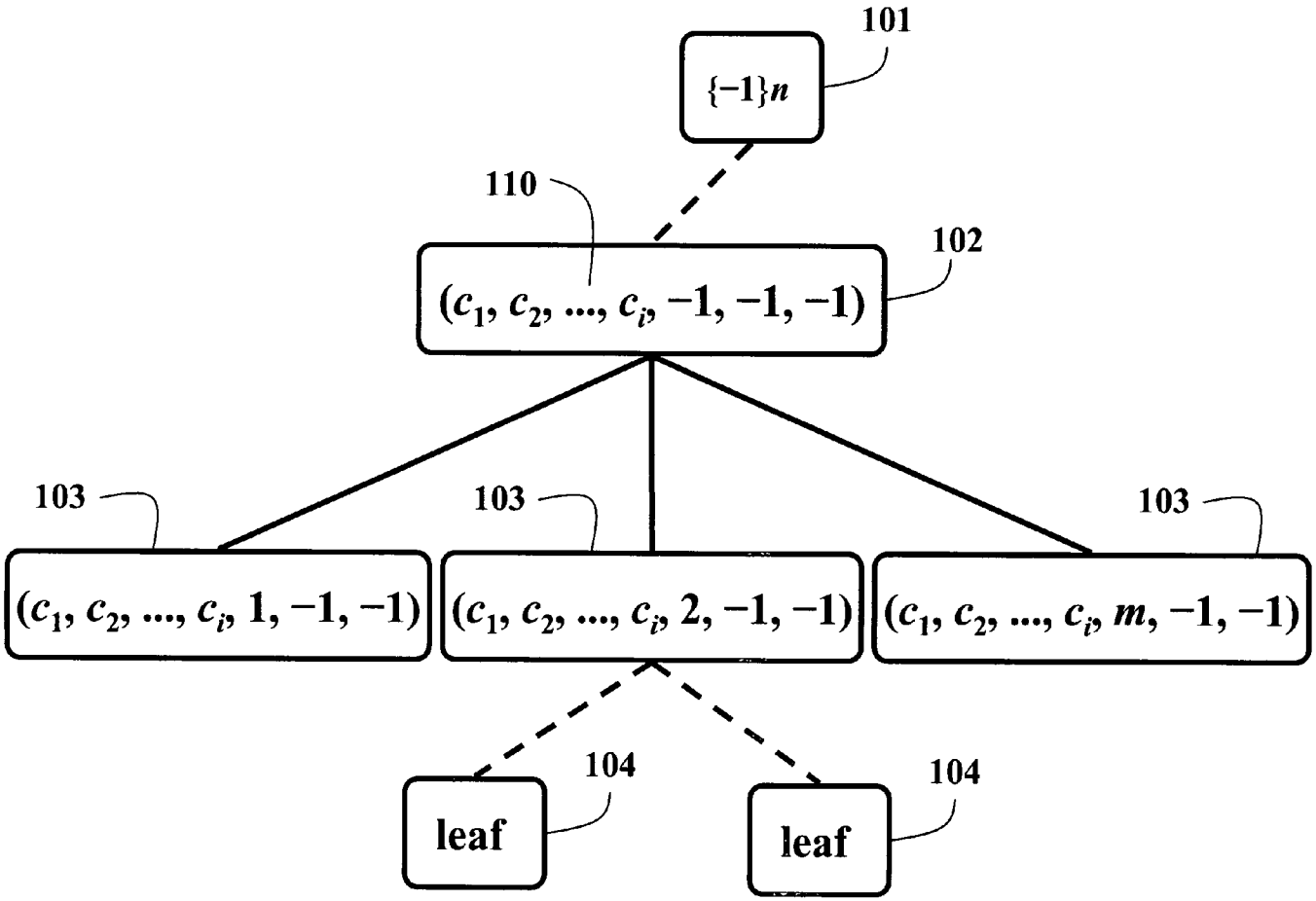
FIG. 1 is a graph of a search tree used by a branch-and-bound process according to an embodiment of the invention.

The embodiments of our invention provide a method for scheduling elevator cars in an elevator system that operates according to a reassignment policy.

An elevator scheduling problem can be characterized by a set of unassigned hall calls H, where each hall call h in the set H is a tuple (f, d) defining an arrival floor f and a desired direction d (up or down). The set of halls are to be assigned to a set of cars of the elevator system.

A state of a car c is determined by its current position, velocity, direction, number of boarded passengers, and the set of hall calls, which constrain the motion of the car. Therefore, for a particular car c, we denote an intrinsic order of hall calls in which the car c can serve passengers by $<_c$, i.e., $h_i <_c h_j$, if and only if call $h_i$ is served by car c before call $h_j$.

In general, there are n! different orders in which a car can serve n unassigned hall calls. The corresponding scheduling problem is known to be NP hard, even for a single car. However, we follow the widely used assumption that a car always keeps moving in its current direction until all passengers requesting service in this direction are served. After the car becomes empty, it may reverse direction.

For each hall call h, the waiting time it takes car c to serve hall call h is denoted by $W_c(h)$. This time depends on the current state of car c, and the specific kinematics of the elevator system, e.g., acceleration, maximum velocity, door open and close times, and start delays. We assume that all these parameters are known to the scheduler to enable a sufficiently precise prediction of travel times.

In addition, the waiting time of passengers strongly depends on other hall calls assigned to the same car. The scheduler also has to account for these hall calls. Due to the uncertainty arising from the unknown destination floors of the newly arriving passengers, we cannot make a precise prediction of the waiting times. Hence, we replace the delays by a statistical expectation of waiting times.

For any subset R of hall calls H, $R \subset H$, the expected waiting time of hall call h on car c is denoted by $W_c(h|R)$, given that the hall calls in the set R are also assigned to car c. It is true that $W_c(h|R) \geqq W_c(h|\emptyset)$, since additional hall calls can only slow down the car, and $W_c(h|R \cup \{g\}) = W_c(h|R)$ if $h <_c g$, where g is an assigned hall call, since hall call g will not slow down the passenger(s) for hall call h, if hall call g is served after hall call h by car c.

We can efficiently determine $W_c(h|R)$ using the ESA-DP method incorporated herein by reference. However, we cannot easily determine $W_c(h|R_1 \cup R_2)$, given solely the individual expectations for $W_c(h|R_1)$ and $W_c(h|R_2)$.

The assignment of the set of hall calls H to m cars is a partition of the set of hall calls H into m distinct subsets $\{H_1, H_2, \ldots, H_m\}$, such that $H_i \cap H_j = \emptyset$, for $i \neq j$, and for $\cup_{i=1}^{m} H_i = H$. For a given car assignment, we denote the car that is assigned to hall call h as c(h).

Minimizing the AWT at a particular decision step is the same as minimizing the sum of residual waiting times of all passengers currently being serviced. Hence, we can define an objective function F of a given assignment set $\{H_1, H_2, \ldots, H_m\}$ as $$F(\{H_1, H_2, \ldots, H_m\}) := \sum_{c=1}^{m} \sum_{h \in H} W_c(h \mid H_i). \tag{1}$$

It is desired to minimize this objective function to find a best solution for our scheduling problem.

Branch-and-Bound

Branch-and-bound (B&B) is a process for systematically solving hard optimization problems using a search tree. B&B is useful when greedy search methods and dynamic programming fail. B&B is similar to a breadth-first search. However, not all nodes of the search tree are expanded as child nodes. Rather, predetermined criteria determine which node to expand and when an optimal solution has been found. Partial solutions that are not as good as a current best solution are discarded, see A. H. Land and A. G. Doig, "An Automatic Method for Solving Discrete Programming Problems," Econometrica, vol. 28, pp. 497-520, 1960, incorporated herein by reference.

We use the B&B process to solve our large scale combinatorial optimization problem of elevator scheduling. While an exponentially growing number of solutions often inhibit explicit enumeration, the ability of the B&B process to search parts of the problem space implicitly frequently leads to an exact solution for a practical sized problem.

The B&B process maintains a pool of yet unexplored subsets of the problem space and a best solution obtained so far. Unexplored subsets of the problem space are usually represented as nodes of a dynamically generated search tree. Initially, the B&B process uses a search tree with a single root node representing all possible assignments, and an initial best solution. Each iteration processes one particular node of the search tree, and can be separated into three main components: selection of the next node to be processed, bounding, and branching.

The B&B process is a general paradigm and a variety of possibilities exists for each of these steps and also for their order. For example, if node selection is based on the bound of the subproblems, then branching is the first operation after selecting the next node to process, i.e., an "eager strategy." Alternatively, we can determine the bound after selecting a node and branch afterwards if necessary, i.e., a "lazy strategy."

Depending on the type of optimization problem, the task of the bounding is to determine a lower bound for the objective function value for the entire subset. If we can establish that the considered subset cannot include a solution that is better than the currently best solution, then the whole subset is discarded.

Branching separates the current search space into non-empty subsets, usually by assigning one or more components of the current solution to a particular value. Each newly created subset is represented by a node in the search tree and added to the pool of unsolved subsets. When the pool consists of a single solution, the single solution is compared to the best solution. The better one of the two solutions is retained, and the other is discarded. The branch-and-bound terminates when there are no more unsolved subproblems left. At this time, the best found solution is guaranteed to be a globally optimal solution.

Figure 2:
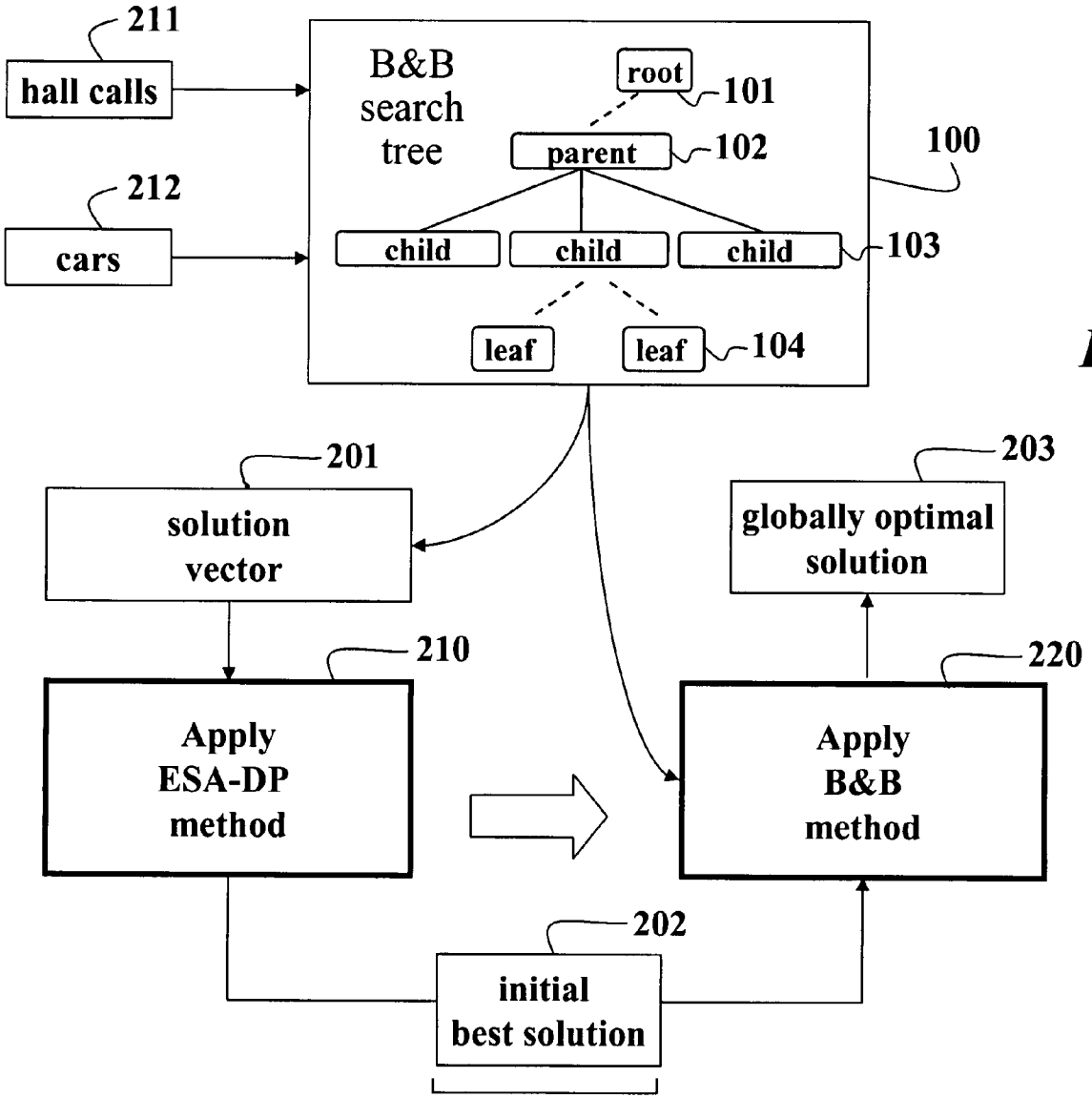
FIG. 2 is a block diagram of a system and method for scheduling elevator cars according to an embodiment of the invention.

FIGS. 1 and 2 show an example B&B search tree 100 maintained according to an embodiment of our invention. The tree has a top level root node 101 representing all possible assignments, one or more intermediate parent nodes 102 with child nodes 103 representing partial assignments, and bottom level leaf nodes 104 representing complete assignments. Note that, initially, the top level node is both a root node and a leaf node. The nodes are processed in a top to bottom order. At any leaf, the node is evaluated to determine a current solution. The node and the whole sub-tree below it are discarded if the current solution cannot possibly improve on the best solution for any assignment of cars in the sub-tree; otherwise, the node is expanded by generating child nodes, and the tree is further descended.

We represent each possible assignment of the set H of n hall calls h to cars $c_i$ by a vector $(c_1, c_2, \ldots, c_n)$ 110, i.e., the possible assignments are partitioned into m distinct subsets. The possible solution vectors are maintained as the B&B tree 100. Car $c_i$ is assigned a value in a range $1 \leqq c_i \leqq m$ for assigned hall calls, and −1 for unassigned hall calls. Every complete solution vector corresponds to a valid assignment, i.e., car $c_i > -1$ for all $1 \leqq i \leqq n$. Thus, a size of the solution space is exponential; more precisely, its size is $m^n$.

Figure 3:
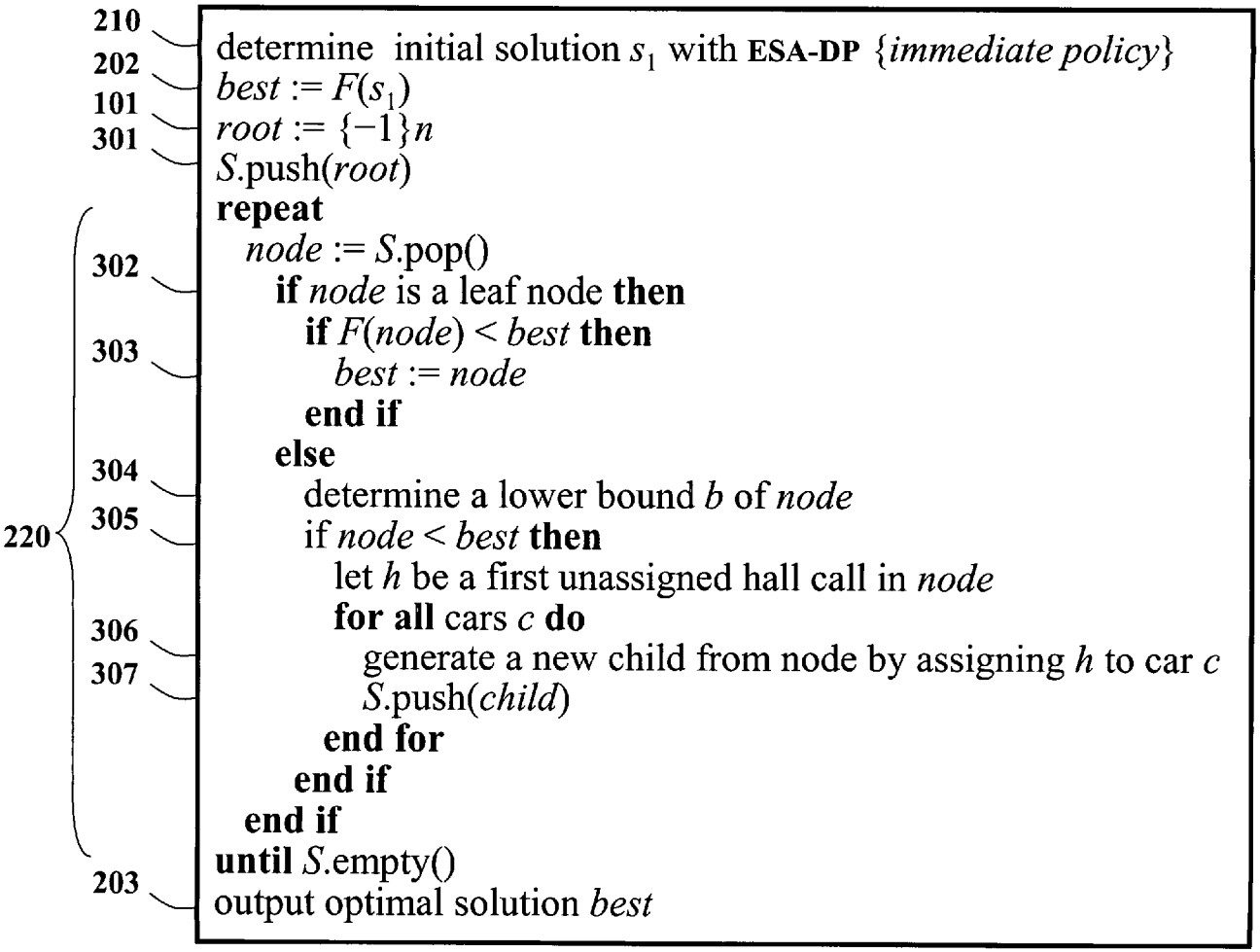
FIG. 3 illustrates pseudo code of a method according to an embodiment of the invention.

As shown diagrammatically in FIG. 2, and with corresponding pseudo-code in FIG. 3, we combine the ESA-DP 210 process with the B&B process 220 for our scheduling method to assign a set of n hall calls 211 to a set of m cars 212 according to the reassignment policy. We select the first unassigned hall call at every iteration, bound its objective function value, and branch, if necessary. The remaining search space is partitioned into m equal sized subproblems by assigning the call to one of the cars, thus generating m child nodes 102.

A solution vector 201 is first evaluated using the ESA-DP process according to the immediate policy by summing up the waiting times of passengers to each of the cars to determine 210 an initial best solution $s_1$ 202 for the solution vector.

The set of unsolved subproblems is maintained using a stack S. Initially, the empty assignment, $x=\{-1\}n$, at the root node 101 is pushed 301 on the stack S. We determine 210 the initial best solution 202 for the partial solution 201 using the EAS-DP method according to the immediate assignment policy.

Whenever we encounter 302 a leaf node 104, i.e., every hall call is assigned to a particular car, we determine an expectation of the average waiting time for this assignment. We replace 303 the best found solution with the current assignment only if the solution for the current assignment is better.

Partial assignments are evaluated by determining 304 a lower bound b. The lower bound is compared 305 to the best solution. If the lower bound b is greater than the value of the best solution of the objective function F so far, then further processing on the node is stopped to effectively discard the leaf node that was popped from the stack.

Otherwise, we generate 306 m child nodes by assigning the first unassigned hall call to one of the available cars and pushing 307 the assignments on the stack. Because the next node to process is always on the top of the stack S, this approach corresponds to a depth-first lazy B&B strategy.

In practice, we sort the car assignments for the hall calls in a first-to-last order according to distances to floors originating the hall calls, and push the assignments in reverse order on the stack, thereby processing more promising car assignments at the top of the stack first.

The success of our B&B process is mainly achieved by two components: (a) the availability of good solutions early in the optimization process, and (b) means for determining tight bounds for each of the branch nodes. We define a tight bound as being a lower bound that is substantially close to the optimal value of the variable being optimized, i.e., minimized in our application.

We achieve (a) by the using the ESA-DP method for the immediate policy, and a depth-first evaluation of the most promising assignments.

The determination of tight bounds is nontrivial. One way to determine the lower bound b for a partial solution is to ignore unassigned hall calls and apply the ESA-DP process. However, that approach does not account for two important issues. Each of the hall calls is inevitably assigned to one of the cars, and we have to account for the increase in waiting time of other passengers as a result of this assignment. Each hall call can introduce delays on hall calls that are served later, which has to be considered in the statistical expectation of their waiting time.

We can always penalize any unassigned hall call h by $\min_c W_c(h|\emptyset)$, i.e., the smallest time that is required to reach the particular floor by any car assuming no other hall calls are assigned to the same car. However, that bound does not allow us to discard large parts of the search tree without explicit enumeration. This is based on the fact that $W_c(h|H_c) \geqq W_c(h|\emptyset)$, which is a special case of the more general inequality $W_c(h|Q \cup R) \geqq W_c(h|R)$, where the set Q contains unassigned hall calls, and Ø is an empty set.

We denote the set of already known assignments to car c by $H_c$. We can generalize the approach above to $W_c(h|H_c) \geqq \max_R W_c(h|R)$, while R ranges over the whole set of hall calls $H_c$. In practice, considering all subsets is infeasible. Instead, we predetermine $W_c(h|R)$ only for subsets R such that $|R| \leqq p$. Here p is a small integer, for example 1, 2, or 3, since the number of all possible subsets of cardinality p grows exponentially in p. We can now determine a penalty P(h) for call h resulting from a partial assignment $H=\cup_{i=1}^{m} H_i$, $h \notin H$, by $$P(h) := \min_c \max_{R \subseteq H_c, |R| \leq p} W_c(h \mid R). \tag{2}$$

The lower bound for a set of hall calls $H \cup Q$ with known assignments of H and unknown assignments of the elements in the set Q is $F(H)+\Sigma_{h \in Q} P(h)$. Because we process hall calls in a particular order $(h_1, h_2, \ldots, h_n)$ $h_i \in H$, we can further speed up the preprocessing procedure for determining $W_c(h|R)$ by omitting hall calls $h_j$ that are processed after $h_i$, i.e., $j \geqq i$. Whenever we are interested in a bound for $h_i$, those hall calls are not yet assigned to a particular car and cannot be used to determine $P(h_i)$. Thus, the number of required calls to ESA-DP 210 for a single hall call $h_i$ can be reduced significantly from $$\sum_{k=0}^{p} \binom{n-1}{k} \text{ to } \sum_{k=0}^{p} \binom{i-1}{k}.$$

The assignment of a hall call $h_j$ to one of the cars does not affect hall calls $h_i$, if $h_i <_c h_j$. For a single car c, it is optimal to process hall calls exactly in the order given by $<_c$, because each hall call introduces a delay on calls that are processed later in the optimization process, and the bounds can be successively increased. However, in general, this order is different for different cars and is heuristically determined in the embodiment described below.

Consequently, we can also replace the determination of F(H) by its lower bound $\Sigma_{h \in Q} P(h)$. This decreases both the time necessary for determining the bound and the tightness of the lower bound. As a result, the search space is pruned less efficiently, and in smaller increments.

Ignoring future passengers, both versions of the B&B process terminate with an assignment with minimum expected AWT over the set of all possible assignments. However, the complexity of the method is significant and can become infeasible for medium sized buildings. Also, the method operates on a 'snapshot' of the real world, as provided by sensors in the elevator system, and the value of the solution decreases as time passes and the system changes, e.g., new passengers arrive or cars cannot stop at a particular floor any more, where they could before.

We describe different proxy criteria that can be used instead of directly minimizing the AWT. The proxy criteria enable a more efficient B&B procedure by incremental calculations of bounds.

Instead of considering all constraints for each hall call, we can deliberately ignore some of the constraints by restricting delays to the p worst hall calls that are assigned to the same car. In a sense, this is an extension of the conventional nearest car heuristic, which determines $W_c(h|\emptyset)$.

We replace an estimation of waiting time for a given assignment $H=H_i$ by $$\sum_{c=1}^{m}\sum_{h\in H_c}\max\max_{R\subseteq H_c|R|\le p} W_c(h\mid R),$$

i.e., instead of considering all hall calls in the determination of waiting time, we use a subset R of bounded cardinality. In general, this procedure underestimates waiting time, and we can expect to obtain better results by increasing p. However, the key feature of this formulation is the possibility to determine the waiting time incrementally while descending the B&B search tree. This means the waiting times determined for nodes higher in the search tree can be used to determine the waiting times for lower nodes.

Figure 4:
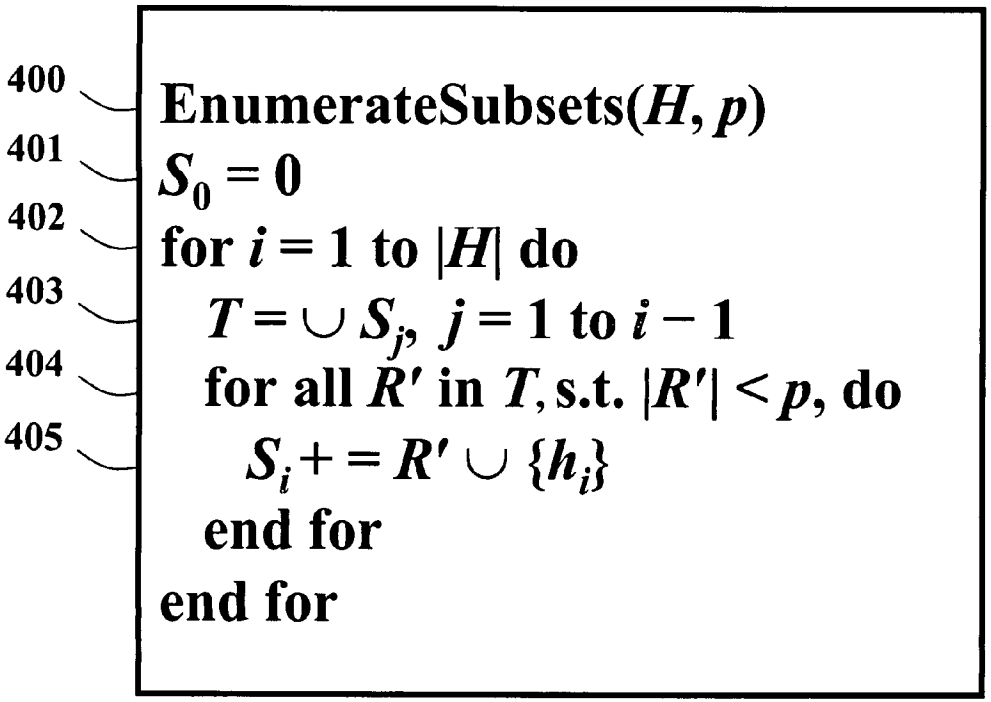
FIG. 4 illustrates pseudo code for enumerating all possible subsets of hall calls.

As the pseudo-code in FIG. 4 shows, we enumerate 400 all possible subsets of hall calls R of cardinality p in such a way that the subsets can be separated into subsets $S_i$ for i=1, . . . , n, such that $S_i$ contains only subsets R consisting of the hall call $h_i$, and subsets of hall calls R' that have been processed before $h_i$, i.e., |R'|<p. Starting with the empty set $S_0$ 401 each hall call is processed in turn 402. For each hall call, we first form 403 the union T of all sets $S_j$, j=1 to i−1 that were generated during previous iterations. Then, iterating 404 over all those subsets R' of T that have cardinality strictly less than p, we augment 405 R' with the new hall call $h_i$.

Furthermore, we maintain a matrix A for each node in the B&B search tree. An element $A_{c,h}$ of the matrix contains the maximum delay caused by any subset R of cardinality up top on hall call h assigned to car c, given the fixed assignments for this node, which was initially $W_c(h|\emptyset)$.

Whenever we insert new nodes in the B&B search tree by assigning a hall call $h_i$ to one of the cars, we ensure that the matrix $A_{c,g}$ remains unchanged for $c\neq c(h_i)$. Only row $c(h_i)$ of the matrix can be updated by determining $$\max(A_{c(h),g},\max_{R\in S_i} W_{c(h)}(g|R))$$

for all assigned hall calls g. The bound for each hall call g with known assignment is available in $A_{c(g),g}$, and the bound for unassigned hall calls h can be determined by $\min_c A_{c,h}$. While this method is also applicable for the bounding procedure described above, we can now also determine the value of the objective function at leaf nodes by $\Sigma_{h\in H}A_{c(h),h}$, and we can omit calls to ESA-DP procedure during the B&B process.

However, the computational complexity of the preprocessing procedure grows exponentially in p, and for small p, we underestimate the residual waiting time significantly.

Pairwise Delay Minimization

In another embodiment of the invention, we minimize directly a sum of pairwise delays between hall calls assigned to the same car. We denote the delay introduced by assigned hall call g on hall call h by $\Delta W_c(h|g)$, i.e., $\Delta W_c(h|g)=W_c(h|g)-W_c(h|\emptyset)$. We now make the objective function $$G(\{H_1, H_2, \ldots, H_m\}) = \sum_{c=1}^{m}\sum_{h\in H_c}\left(W_c(h\mid\emptyset) + \sum_{g\in H_c}\Delta W(h\mid g)\right) \tag{3}$$

In this objective function, the true wait $W_c(h|H_c)$ that the passenger indicating hall call h would experience if assigned to car c, due to all other passengers in $H_c$ that are also assigned to the same car, has been replaced by the sum $$W_c(h\mid\emptyset) + \sum_{g\in H_c}\Delta W(h\mid g)$$

consisting of individual pair-wise delays each of these passengers would cause for h.

However, this replacement is not always exact, and does not correspond to the exact estimation of waiting time due to numerous reasons. When the car can reach its maximum speed between two successive hall calls assigned to the car, the replacement is always exact. In such cases, the individual hall calls act independently, and their joint delay is equal to the sum of their individual delays.

However, more typically the car cannot reach its maximum speed between two successive calls, for example, when the calls originate on two adjacent floors. In such cases, depending on the location and interaction between hall calls, $G(\{H_1, H_2, \ldots, H_m\})$ is either an overestimate or an underestimate of $F(\{H_1, H_2, \ldots, H_m\})$, and cannot serve as a strict lower bound to be used in the branch-and-bound process. However, in this embodiment of the invention, we use $G(\{H_1, H_2, \ldots, H_m\})$ directly as the objective function to be minimized, and describe below how to determine efficiently a tight lower bound for the objective function.

Furthermore, we speed up the practical run time of the brand-and-bound process algorithm. We can predetermine the value $W_c(h|g)$ efficiently by exploiting the fact that only one of $\Delta W_c(h|g)$ and $\Delta W_c(g|h)$ is non-zero. We can also incrementally determine the objective function during the B&B process and use the intermediate results as tight lower bounds on the objective function. Apart from the preprocessing procedure, no additional calls to the ESA-DP process are necessary during the B&B evaluation.

In order to determine the objective function, Equation (3), we maintain a matrix W for each node of the search tree that is initialized with $W_c(h|\emptyset)$ for the root node 101. At each instance in the optimization process, $W_{c,h}$ contains the sum of $W_c(h|\emptyset)$, and the individual delays of all hall calls assigned to car c so far.

Therefore, we can propagate the matrix W for each node from its parent node, and when assigning hall call h to car c(h), we can update the propagated row $W_c(h)$ by adding $\Delta W_{c(h)}(h|g)$ to each of the elements $W_{c(h),g}$. In essence, with this step, when we assign hall call h to car c, we account for the delay this hall call would cause on all hall calls previously assigned to the same car.

Let $H=P\cup Q$, $P\cap Q=\emptyset$ be any partial assignment with fixed cars for P and unknown assignments for the elements in Q. We can define $$w(h) = \begin{cases} W_{c(h),h} & \text{if } h\in P \\ \min_c W_{c,h} & \text{if } h\in Q \end{cases},$$

and determine both a lower bound for intermediate nodes and the value of the objective function at leaf nodes 104 by $\Sigma_{h\in H}w(h)$.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for scheduling cars of an elevator system, comprising the steps of:

representing each possible assignment of a set of hall calls to a set of cars by a solution vector maintained as a node in a search tree;

evaluating each solution vector using an ESA-DP process according to an immediate policy to determine initially a best solution; and applying a branch-and-bound process to each solution vector using the initial best solution and the search tree to determine a globally optimal solution for scheduling the cars according to an reassignment policy.

2. The method of claim 1, in which the search tree includes a top level root node representing all possible assignments, intermediate parent and child nodes representing partial assignments, and bottom level leaf nodes representing complete assignments.

3. The method of claim 1, in which each solution vector is $(c_1, c_2, \ldots, c_n)$, where $c_i$ a particular one of m cars and n is the number hall calls, and further comprising:

assigning, to the particular car $c_i$, a value in a range $1 \leqq c_i \leqq m$ for assigned hall calls, and −1 for unassigned hall calls.

4. The method of claim 2, further comprising:

partitioning the set of hall calls into m distinct subsets $\{H_1, H_2, \ldots, H_m\}$, such that $H_i \cap H_j = \emptyset$, for $i \neq j$, and for $\cup_{i=1}^{m} H_i = H$, wherein m is the number of cars c;

determining an expectation of an average waiting time by minimizing an objective function F $$F(\{H_1, H_2, \ldots, H_m\}) := \sum_{c=1}^{m} \sum_{h \in H} W_c(h \mid H_i),$$

when the solution vector is represented by a leaf node to determine a current solution; and replacing the best solution with the current solution.

5. The method of claim 4, further comprising:

determining a lower bound for the current solution;

discarding the leaf node if the lower bound exceeds the best solution; and otherwise generating m child nodes from leaf node.

6. The method of claim 1, further comprising:

sorting the assignments of the hall calls to the cars in a first-to-last order according to distances to floors originating the hall calls.

7. The method of claim 1, in which an intrinsic order in which the set of hall calls are assigned to a particular car depends on a direction of travel of the particular car.

8. The method of claim 4, in which the nodes of the search tree are processed in a top-to-bottom order, and the expectation of the average waiting time is determined incrementally while descending the search tree.

9. The method of claim 1, further comprising:

pruning substantial portions of the search tree using a tight bound which is substantially close to the globally optimal solution.

* * * * *